US012752337B2

(12) United States Patent
Paternoster et al.

(10) Patent No.: US 12,752,337 B2
(45) Date of Patent: Oct. 6, 2026

(54) CASTING MOLD FOR PRODUCING A CASTING HAVING A FRONT SIDE AND A REAR FROM A CURABLE CASTING COMPOUND

(71) Applicant: Schock GmbH, Regen (DE)

(72) Inventors: Rudolf Paternoster, Rinchnach (DE); Xaver Pledl, Zwiesel (DE); Alois Probst, Regen (DE); Markus Müller, Regen (DE)

(73) Assignee: SCHOCK GMBH, Regen (DE)

( * ) Notice: Subject to any disclaimer, the term of this patent is extended or adjusted under 35 U.S.C. 154(b) by 372 days.

(21) Appl. No.: 18/494,954

(22) Filed: Oct. 26, 2023

(65) Prior Publication Data

US 2024/0165695 A1 May 23, 2024

(30) Foreign Application Priority Data

Nov. 21, 2022 (DE) ..... 10 2022 130 760.3

(51) Int. Cl.
*B22C 9/02* (2006.01)
*B22C 19/00* (2006.01)

(52) U.S. Cl.
CPC ..... *B22C 9/02* (2013.01); *B22C 19/00* (2013.01)

(58) Field of Classification Search
CPC ... B22C 9/02; B22C 19/00; B29C 2045/1741; B29C 33/14; B29C 45/43;
(Continued)

(56) References Cited

U.S. PATENT DOCUMENTS 4,889,480 A * 12/1989 Nakamura ..... B29C 45/332 425/DIG. 58
5,147,657 A * 9/1992 Giza ..... B29C 45/2806 425/117

(Continued)

FOREIGN PATENT DOCUMENTS

DE 10313788 A1 10/2004
DE 102013223982 A1 5/2014

(Continued)

OTHER PUBLICATIONS

Canadian Patent Office issued an Office Action on Feb. 20, 2025 regarding parallel Canadian Patent Application No. 3219398, 5 pages.

(Continued)

*Primary Examiner* — Nahida Sultana
(74) *Attorney, Agent, or Firm* — LUCAS & MERCANTI, LLP; Klaus P. Stoffel

(57) ABSTRACT

A casting mold for producing a casting having a front side and a rear side from a curable casting compound, including at least a first mold part shaping the front side and a second mold part shaping the rear side, the mold parts together delimiting a casting cavity. A slide device, provided on one of the mold parts, includes a slide portion that can be driven into the casting cavity and on which a detachable insert part is or can be arranged. The insert part is able to be moved abutting against the opposite mold part and is able to be embedded into the curing casting compound, and is detached from the slide portion when the latter is moved back.

18 Claims, 7 Drawing Sheets

(58) Field of Classification Search
CPC ..... B29C 33/0033; B29C 33/0011; B29C 45/14073; B29C 67/246; B29C 33/308; B29L 2031/769; B29L 2031/7698; B29L 2031/7692
See application file for complete search history.

(56) References Cited

U.S. PATENT DOCUMENTS

| | | | | | |
|---|---|---|---|---|---|
| 5,167,898 | A * | 12/1992 | Luther | B29C 45/2628 249/150 |
| 5,326,240 | A | 7/1994 | Kudo | |
| 5,862,853 | A * | 1/1999 | Eliat | B22D 17/24 249/177 |
| 9,808,975 | B2 | 11/2017 | Chappel | |
| 2003/0011104 | A1 | 1/2003 | Hock | |
| 2012/0267815 | A1* | 10/2012 | Tokunou | B29C 45/34 425/546 |

FOREIGN PATENT DOCUMENTS

| | | | | |
|---|---|---|---|---|
| DE | 102012024056 | A1 | 6/2014 | |
| EP | 1237694 | B1 | 3/2004 | |
| JP | S4982440 | A | 8/1974 | |
| JP | S56150524 | A | 11/1981 | |
| WO | 2001043936 | A2 | 6/2001 | |
| WO | WO-0143936 | A2 * | 6/2001 | B29C 33/0011 |
| WO | WO-2005058574 | A2 * | 6/2005 | B29C 45/14073 |

OTHER PUBLICATIONS

German Office Action Dated May 17, 2023, 5 Pages.
Intellectual Property India issued an Office Action dated Mar. 18, 2026 regarding parallel Indian Patent Application No. 202314078702, 11 pages.
Chinese Patent Office issued an Office Action dated Jun. 1, 2026, regarding parallel Chinese Patent Application No. 202311487539.X, 6 pages.
Canadian Patent Office issued an Office Action dated Jun. 10, 2026 regarding the parallel Canada Patent Application No. 3,219,398, 6 pages.

* cited by examiner

CASTING MOLD FOR PRODUCING A CASTING HAVING A FRONT SIDE AND A REAR FROM A CURABLE CASTING COMPOUND

CROSS-REFERENCE TO RELATED APPLICATIONS

The present application claims priority of DE 10 2022 130 760.3, filed Nov. 21, 2022, the priority of this application is hereby claimed, and this application is incorporated herein by reference.

BACKGROUND OF THE INVENTION

The invention relates to a casting mold for producing a casting having a front side and a rear side from a curable casting compound, comprising at least a first mold part shaping the front side and a second mold part shaping the rear side, said mold parts together delimiting a casting cavity.

Such a casting mold, as is known for example from EP 1 237 694 B1, is used to produce castings from a curable casting compound which preferably comprises a polymer matrix and fillers introduced therein for producing composite castings. An example of castings that can be produced here are kitchen sinks which have a correspondingly complex, three-dimensional shape which is mapped by way of the casting cavity or the shape of the two metal layers. However, other castings such as washbasins, shower trays and the like may also be produced by way of such a casting mold.

To produce the casting, the casting compound is introduced into a casting cavity which is delimited by way of two mold parts. The first mold part is used to shape the front side of the casting, and the second mold part is used to shape the rear side.

The casting compound is a curable reaction compound, for example a reaction compound based on polyacrylate or polymethacrylate. The reaction compound is introduced into the casting cavity under a pressure of several bar in order to ensure that said cavity is filled completely, after which the polymerization process is started. For this purpose, in the case of the casting mold known from EP 1 237 694 B1, heat is introduced by way of a heating device, which leads to a heating of the casting compound. For this purpose, in the case of the known casting mold, a first metal layer forming the front side is provided on the first mold part and is heated by way of the heating device, such that the casting compound, which bears against said first metal layer, is inevitably also heated. If the casting compound is heated above the polymerization temperature, the exothermic polymerization reaction begins, the polymerization front moving successively through the casting compound to the opposite second metal layer. Here, as a consequence of the reaction, a reduction in volume of the reacting, curing casting compound, that is to say a shrinkage or a loss of the polymer material, occurs. In order to avoid a situation in which, as a consequence of the shrinkage, that side or surface of the casting which is being formed detaches from the respective metal layer provided on both mold parts, which may lead to surface defects, shrinkage compensation is provided in the case of the known casting mold by virtue of one of the two metal layers, in said known casting mold the metal layer shaping the rear side, being movably mounted, such that the metal layer is able to track the shrinking casting compound or the shrinking casting and a permanent areal abutment of the casting compound or the casting against the movable metal layer is ensured. It is also known to use casting molds whose mold parts can be moved relative to one another for shrinkage compensation. Particularly for casting compounds which cure already at ambient temperature, use is also made of casting molds which consist of a GRP carrier body with a superficial plastics layer.

In the case of a casting produced with such a casting mold or a molding, the formation of an aperture, for example an outflow hole in the case of a kitchen sink, a shower tray or a washbasin, is often required. To this end, the finished molding produced with the casting mold is subjected to mechanical postprocessing by virtue of a suitable tool being used to produce the corresponding, usually circular, aperture, the molding is thus correspondingly drilled. This mechanical postprocessing of the continuously cast molding, i.e. cast in closed form, is awkward, time-consuming and cost-intensive.

SUMMARY OF THE INVENTION

The invention is based on the problem of specifying an improved casting mold which makes it possible to already form such an aperture during casting.

To solve this problem, a casting mold of the type mentioned in the introduction is characterized by a slide device, provided on one of the mold parts, comprising a slide portion which can be driven into the casting cavity and on which a detachable insert part is or can be arranged, said insert part being able to be moved abutting against the opposite mold part and being able to be embedded into the curing casting compound, and being detached from the slide portion when the latter is moved back.

The casting mold according to the invention is distinguished by a slide device which is provided on a mold part, preferably the mold part forming the front side, and which has a movable slide portion that can be driven into, and moved back out of, the casting cavity. Arranged on this slide portion is a detachable insert part which can be driven into the casting cavity together with the slide portion and which can be brought into direct abutment against the opposite mold part by way of the slide device.

During production, the slide device or the slide portion with the insert part arranged thereon is in the retracted non-working position, this means that the slide portion together with the insert part is not driven into the casting cavity in a working position or the insert part is not in abutment against the opposite mold part. This makes it possible for the fluid casting compound to be readily introduced into the casting cavity and to completely fill the latter. After the casting cavity has been filled with the casting compound, the slide device is actuated by way of a corresponding control device, such that the slide portion together with the insert part is extended and brought into the actual working position, in which the insert part bears against the opposite second mold part. The insert part accordingly displaces the casting compound during the displacement into the working position, and it bears directly against the second mold part in the working position such that there is barely any casting compound in the abutment region but the insert part is completely laterally surrounded by the casting compound. This means that the insert part defines the corresponding aperture that is intended to be provided on the finished molding.

After the insert part has been extended and moved into the working position, the actual polymerization or curing operation of the casting compound is effected, for which for example a heat input that initiates the polymerization is effected, for example by way of an appropriate metal layer, wherein for example metal layers corresponding to the two mold parts and delimiting the casting cavity are provided. After the polymerization has concluded, that is to say when the overall casting compound has fully polymerized, the mold is opened and the polymerized molding is demolded. The molding cools down to room temperature outside the mold and finally cures. Shortly before the mold is opened, the slide device drives back again, that is to say the slide portion is retracted. Here, the insert part detaches from the slide portion; as described, it is firmly embedded and anchored into the cured casting compound such that the former fixing to the slide portion can be readily canceled when the latter is driven back. The cured molding together with the embedded insert part is then demolded, i.e. removed from the first mold part, preferably by means of compressed air, after which it is merely necessary to remove the insert part remaining in the molding from the molding. This is readily possible since the contact surface between the insert part and the molding is relatively small owing to the thin wall thickness of the molding, that is to say for example of the kitchen sink or the washbasin or the shower tray, with the result that there is only a low degree of adhesion between the insert part and the molding. This can be reduced even further if the insert part is composed of a material that adheres as little as possible, if at all, to the cured casting compound. By way of example, the insert part may be knocked out with a hammer or otherwise pushed out. The removal of the insert part is also made easier by the different expansion coefficients between the molding and the insert part.

The casting mold according to the invention consequently allows an aperture to already be formed in a simple manner during the casting, and therefore complex mechanical post-processing, apart from the simple removal of the insert part, is not required. Due to the fact that the insert part is arranged on the slide portion and is only brought into the working position, delimiting the casting cavity, by way of said slide portion, neither the slide portion nor the insert part obstruct the filling of the cavity, and therefore it is ensured that the casting cavity is filled optimally, which would not be the case if the insert part were to be positioned prior to the closing of the mold halves and were to already be in the casting cavity during the filling. The combination of the slide portion and of the insert part arranged thereon can also ensure that a sufficient tightness is provided, which prevents undesired ingress of the casting compound into gaps and the like. And, lastly, the detachability of the insert part ensures that no problems occur during the movement back into the non-working position, which would possibly be the case if the insert part were to still be on the slide portion.

According to an expedient refinement, provision may be made for the mold part comprising the slide device to have, on the side delimiting the casting cavity, a recess in which the slide portion is received and out of which the slide portion is at least partially movable. The mold part thus has a corresponding recess which receives the slide portion and expediently also the insert part and which may, for example, be formed on a possible metal layer provided there. Due to the fact that the slide portion together with the insert part is received in the recess in the non-working position, it is ensured that they in no way restrict the free cross section of the casting cavity, which is conducive to the filling since the flow path of the casting compound is not impeded by the slide portion or the insert part. The free cross section of the casting cavity is consequently open.

In this case, the slide portion may have an encircling sealing element, for example a corresponding ring seal, which provides sealing with respect to the wall of the recess. This forms a corresponding sealing plane already between the slide element and the mold part, said sealing plane ensuring that an undesired inflow of casting compound is prevented.

The insert part itself may have a base plate and an encircling flange which peripherally adjoins said base plate, wherein, in the assembled position, the base plate sits on a supporting surface of the slide portion and the flange engages into an encircling receiving rabbet in the slide portion and is at least partially received in the recess. The insert part is accordingly of pot-like or trough-like embodiment and has, at least on the side facing and contacting the other mold half, a planar base plate which is for example round or rectangular, from which base plate a corresponding flange, for example an annular flange or an encircling rectangular flange, projects. The base plate sits on a corresponding supporting surface of the slide portion in an areal manner, such that it can correspondingly be pushed forcefully against the other mold half. By contrast, the flange engages into a corresponding rabbet on the slide portion and is also at least partially received, at least in the non-working position, but preferably also in the working position, in the corresponding recess together with the slide portion. Since the slide portion has a rabbet which is open toward the side, the flange is correspondingly directly adjacent to the recess wall, and therefore a kind of sealing seat can also be produced in this region.

Preferably, the recess and the slide portion are cylindrical, the insert part then having a round base surface and an annular flange which engages into an annular rabbet in the slide portion. This is the preferred, customary construction, since corresponding outflow apertures are usually circular. In this case, the annular flange may have a slight conicity, that is to say taper marginally toward the free side, which makes insertion into the recess easier. An opening angle of e.g. 0.5-1.5° is expedient.

As an alternative, the recess and the slide portion may have a cross-sectional shape which deviates from a circular shape, wherein the insert part has a base plate which is shaped correspondingly to this cross-sectional shape and a flange which engages into a receiving rabbet in the slide portion. The cross-sectional shape may deviate from a circular shape in any desired manner, that is to say may be any desired shape, e.g. polygonal, i.e. triangular, quadrangular or pentagonal, or oval. The shape of the insert part is formed correspondingly. The flange provided here, which corresponds to the recess shape, may also have a slight conicity here.

Expediently, in the non-working position, the base plate is arranged flush with a peripheral surface, delimiting the recess, of that side of the mold part, possibly also of the already described metal plate, which delimits the casting cavity. This means that, as far as the filling operation is concerned, the mold surface is also continued or defined by way of the base plate in the region of the recess.

An expedient refinement of the invention provides for the flange, in particular the annular flange, to bear in sealing abutment against the wall of the, preferably cylindrical or otherwise shaped, recess at least when the insert part is in the position bearing against the other mold part. A genuine sealing abutment between the insert part flange and the recess wall is thus accordingly implemented, and therefore an additional sealing plane is produced.

In this case, the rabbet may have a chamfer against which the free end of the flange bears, wherein, during the movement of the slide portion in the direction of the other mold part or upon contact against the other mold part, the flange slides along the chamfer of the rabbet and widens in encircling fashion against the wall. This chamfer geometry ensures that the flange is necessarily pushed into a firm sealing abutment against the wall of the recess, regardless of which specific shape the recess and the slide portion and the insert part have. The virtually pot-like insert part is placed onto the slide portion in such a way that it initially bears with the free edge of the flange against the chamfer of the slide portion. If, once the casting cavity has been filled, the slide portion together with the insert part is then extended, a pressure builds up on the insert part or the base plate which, as already mentioned, is pushed into the casting compound, such that the insert part is pushed slightly further axially onto the slide portion. Here, the flange slides outward slightly on the chamfer and is outwardly widened in encircling fashion, such that it is pressed into sealing abutment against the recess wall. This movement of the insert part may be effected already during the pushing through the casting compound, or alternatively only when said insert part runs against the other mold half.

In order to achieve simple widening, the wall thickness of the flange, whether it be cylindrical, angular or oval, is expediently reduced at its free end, in the region of which the flange rests on the rabbet in the slide portion.

An expedient refinement of the invention provides for the recess, no matter how it is shaped (for example cylindrical, angular or oval), to have, at the end facing the casting cavity, an encircling sealing edge which bears sealingly against the inserted insert part. This edge projects marginally into the recess, such that it pushes or bears against the insert part.

In this case, the insert part may have a chamfer at its facing outer edge in the position bearing against the other mold part. This makes the demolding of the finished molding easier. For the demolding, compressed air at several bar, usually about 8 bar, is applied to the slide portion or the insert part by way of the slide device, and from there it flows under the cast molding and detaches the latter from the mold half comprising the slide device. Since this demolding is effected after the upper mold half has already been removed, thus the molding is virtually exposed, this chamfer, which is inevitably filled with cured casting compound that forms an encircling periphery and that in turn forms an abutment for the insert part, ensures that the insert part is not, as it were, shot out of the mold part by the considerably high pressure. The, as it were, poured-out undercut is sufficient to prevent this. The chamfer should have, for example, a width of about 0.5-2 mm and a chamfer angle of 35°-55°, preferably a width of 1 mm and a chamfer angle of 45°.

In a refinement of the invention, the slide device may also be used as an ejector device for lifting the cured casting off from the mold part. This means that, in addition to the introduced compressed air, the slide device is also actuated and the slide portion is raised, such that the cast molding is also actively lifted. To this end, a compressed-air distributing device may be provided on the slide device and can be used to conduct compressed air onto the lower side of the insert part, said lower side being seated on the slide portion.

The insert part itself is preferably composed of plastic, in particular of polypropylene. The insert part must have an appropriate thermal and chemical resistance to the casting compound, and it should simultaneously also adhere as little as possible to the casting compound or the cured molding. Here, plastic has proven to be a suitable material, with preference being given in particular to polypropylene. This is also because the insert part is, as stated, for example knocked out with a hammer and potentially cannot be used again. In addition, the expansion coefficient of the insert part material is preferably considerably greater than that of the casting compound or the casting, such that the insert part shrinks marginally during the cooling and detaches slightly from the mold part, which makes the removal of the insert part easier.

Lastly, provision may be made for the first mold part to have a first metal layer delimiting the casting cavity and for the second mold part to have a second metal layer delimiting the casting cavity, as already described above in an optional manner, and as known from EP 1 237 694 B1. These metal layers are preferably thin nickel sheets. The recess is then expediently formed in one of the two metal layers, depending on which of the two mold parts is provided with the slide device.

At least one or the metal layer of the mold part against which the insert part is moved may also be at least partially deformable for the purpose of changing the volume of the casting cavity. This deformation of the metal layer makes it possible to compensate for shrinkage, which occurs during the curing of the casting compound, since the metal layer is capable of deforming correspondingly and thus of tracking. Continuous contact between the curing casting compound and the two metal layers is accordingly ensured. As an alternative, it is also possible for at least one mold part to be movable relative to the other mold part for the purpose of changing the volume of the casting cavity. Here, for shrinkage compensation, an active movement of both mold parts relative to one another is performed by way of suitable actuating means; a metal layer is not moved here.

In this case, according to a particularly advantageous refinement of the invention variant with the movable metal layer, the mold part may have an areal intermediate layer which is composed of an elastically deformable and compressible material and against which the metal layer of the mold part is movable with built-up of a restoring force on the part of the deforming intermediate layer. Accordingly, an areal intermediate layer composed of an elastically deformable and compressible material, for example a foam rubber, is provided as a fixed, integrated constituent part of one of the two mold parts. This areal intermediate layer or the layer material is capable of being compressed with corresponding pressure, which pressure is built up by way of the introduced casting compound, but is also capable of being restored again when pressure is released. This means that a restoring force suitable for transferring the intermediate layer back into the starting shape is built up in the event of a compression. According to the invention, one of the two metal layers is movable against this elastic and compressible intermediate layer, namely the metal layer against which the insert part is moved. The insert part is pushed against this movable metal layer by way of the slide device, wherein the slide device can correspondingly reproduce this restoring movement of the metal layer, such that in this way the restoring and thus the shrinkage compensation via the movable metal layer is not impeded.

As described, the fluid casting compound is introduced into the casting cavity under a pressure of for example 2-5 bar. This high pressure in the casting cavity then has the result that the metal layer, which is ultimately movable by way of the elastic and compressible intermediate layer, is moved out of its starting position, that is to say is pushed against the elastic and compressible intermediate layer which is compressed with build-up of a restoring force. After completion of the filling operation, the slide portion together with the insert part is introduced into the casting compound which is under corresponding pressure, and therefore a corresponding pressure inevitably acts on the insert part, which leads to the movement of the flange into sealing abutment against the recess wall, as described above. Once the insert part occupies the position abutting against the other mold part or the other metal layer, the curing, that is to say the actual polymerization reaction, is initiated, usually by an input of heat into the casting compound. The heat input may be effected, for example, by way of the first mold part, that is to say the first metal layer, which is heated for this purpose. The exothermic polymerization reaction starts, resulting in increasing shrinkage as the polymerization progresses. However, if the volume of the casting compound or of the molding which is gradually polymerizing to completion reduces as a consequence of the reaction, this shrinkage is automatically compensated by virtue of the movably mounted metal layer performing tracking by way of the relaxing intermediate layer, that is to say the intermediate layer expands again and pushes the metal layer down. Accordingly, the casting cavity is gradually made smaller, so as to follow the shrinkage of the casting compound polymerizing to completion. Automatic tracking or restoring is accordingly realized by way a means which is integrated into a mold part, namely the elastic areal intermediate layer. This movement can readily be reproduced by way of the slide device, and therefore this restoring movement is in no way impeded.

In the case of the variant with a moving mold part, the movement thereof relative to the non-moving mold part is correspondingly controlled by way of a control device which the actuating means that move the mold part. In this way, the one mold part is correspondingly raised or lowered, wherein both mold parts can of course also be moved.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
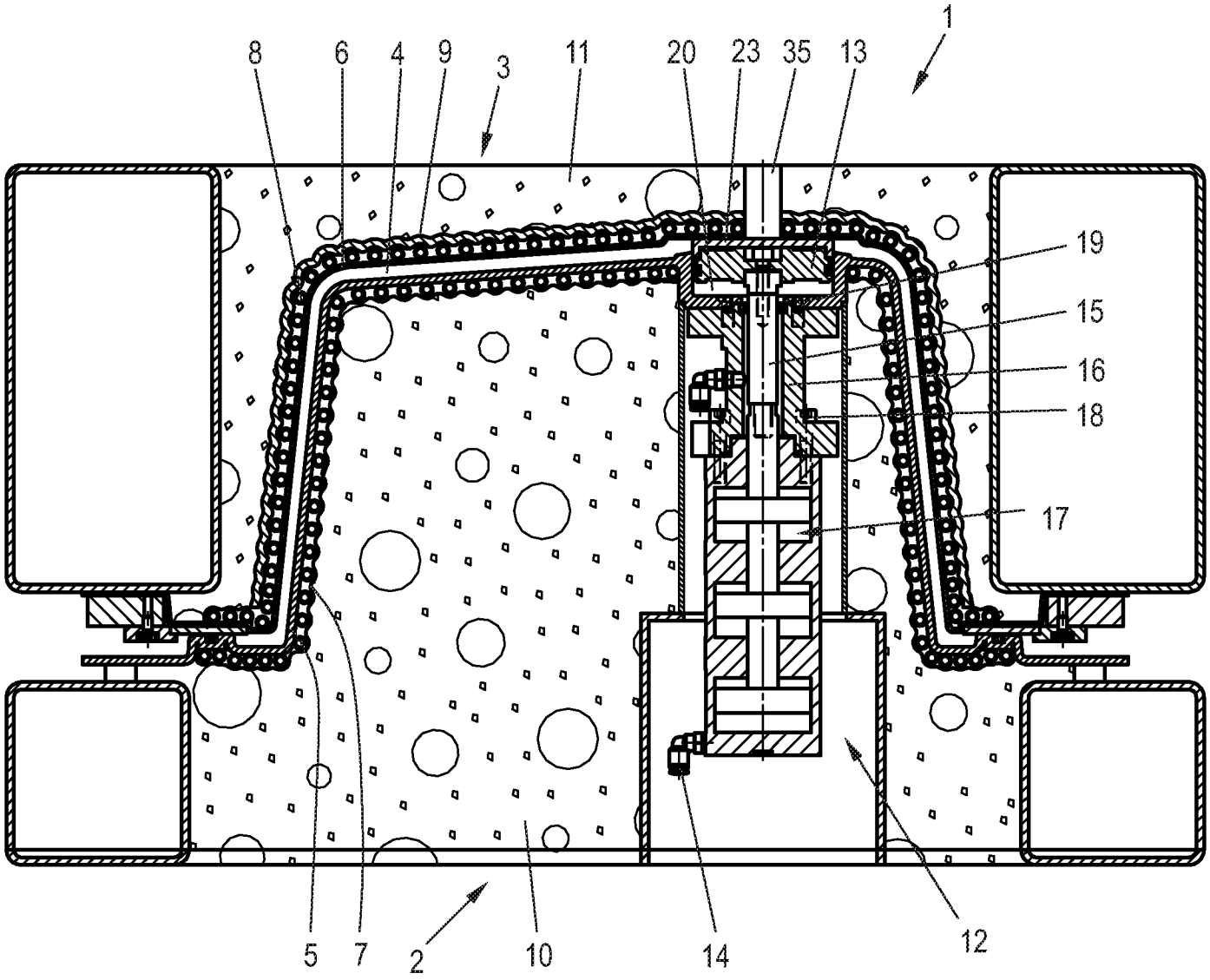
FIG. 1 shows a diagrammatic illustration of a casting mold according to the invention in the closed state.

FIG. 1 shows a diagrammatic illustration of a casting mold 1 according to the invention which is used to produce a casting, having a front side and a rear side, in the form of a kitchen sink consisting of a composite material. The casting mold 1 comprises a first mold part 2 which is used to shape or define the front side of the casting to be produced, and a second mold part 3 which is used to shape or define the rear side of the casting to be produced. Both mold parts 2, 3 bear peripherally against one another and delimit a casting cavity 4 into which a casting compound consisting of a curable polymer compound, that is to say a reaction compound, into which particulate fillers such as quartz sand and the like are introduced, can be introduced under pressure. To this end, a filling opening 35 is provided on the second, upper mold part 3 and can be used to introduce the casting compound into the casting cavity 4. While the first mold part 2 is positionally fixed, the second mold part 3 can be moved vertically, that is to say can be placed onto the lower first mold part 2 for the purpose of closing the casting cavity 4.

The casting cavity 4 is delimited by a first metal layer 5, which is arranged on the first mold part 2, and a second metal layer 6, which is arranged on the second mold part 3. Both metal layers are preferably nickel sheets. The introduced casting compound comes into contact with these two metal layers 5, 6, that is to say bears against these two metal layers 5, 6 in an areal manner. In this case, a first heating device 7, which covers the rear side of the first metal layer 5 in a virtually full-area manner, is arranged on the rear side of the metal layer 5. This heating device 7 can be used the temperature of the first metal layer 5, and said first metal layer can be used to heat the casting compound from the front side. The second mold part also has a second heating device 8 which is arranged on the rear side of the second metal layer, so as to ultimately cover it in a full-area manner. The second heating device 8 can be used to control the temperature of the second metal layer 6, and said second metal layer can be used to control the temperature of the casting compound, consequently it is thus possible to control the heat input into the casting compound from the rear side. The second heating device 8 is followed by an elastic and compressible intermediate layer 9, preferably composed of a foam rubber, which elastic, compressible intermediate layer constitutes a restoring means or restoring element which makes a certain degree of movability of the second metal layer 6 possible and which at the same time ensures that the second metal layer 6 can be returned back into a defined starting position.

If the casting operation is commenced, the second metal layer 6 is in its starting position, and the casting cavity 4 has a defined starting volume. The second metal layer 6 is at a defined spacing to the first metal layer 5, and the intermediate layer 9 is relaxed or compressed only to a slight extent, if at all. At the beginning of the casting operation, the casting compound, which may for example be a sufficiently flowable compound based on polyacrylate or polymethacrylate, is introduced into the casting cavity at a pressure of about 2-5 bar. As a result of the casting pressure, a correspondingly high surface pressure builds up in the direction of the two metal layers 5, 6. The position of the first metal layer 5 does not change, since it is supported directly on a first mold part carrier 10. By contrast, the second metal layer 6 evades the pressure which is building up, since it is supported via the intermediate layer 9 on the second mold part carrier 11. The volume of the casting cavity can consequently be increased due to the high injection pressure. The polymerization process is then initiated, usually by actuating the first heating device 7. Both the first heating device 7 and the second heating device 8 are tubular, hose-like heating elements which are laid, for example, in a meandering manner and through which a temperature-control fluid is guided. The heating elements are embedded into an appropriate thermally conductive compound. Heating of the casting compound in the casting cavity 4 occurs, said casting compound increasing in volume to some extent as a consequence of the temperature, which leads to further compression of the intermediate layer 9. If the local heating at the interface to the first metal layer 5 is so great that a polymerization start temperature is reached, the exothermic polymerization reaction begins at this interface, that is to say that the polymer matrix is polymerized to completion, wherein the polymerization front gradually migrates into the casting compound, that is to say moves in the direction of the second metal layer. In this case, the temperature of the second metal layer is also controlled in due course by way of the second heating device 8, in order to also control the polymerization reaction from this side. Because it is exothermic, the reaction progresses automatically from both sides within the volume.

The polymerization is also accompanied by shrinkage of the casting compound or of the polymerization body being produced, thus by a reduction in volume. In order to ensure that the casting compound or the completely polymerized outer skin of the casting is always in contact with both metal layers, the second metal layer 6 is then automatically moved by way of the compressed intermediate layer 9, which is relaxed and restored, that is to say the second metal layer 6 tracks the shrinkage, so as to compensate for it. The integration of the elastic, compressible intermediate layer 9 accordingly enables automatic adjustment, in order to achieve shrinkage compensation.

As described, the two mold parts 2, 3 also consist of corresponding mold part carriers 10, 11 which each consist of a polymer concrete, consisting of a polymer matrix containing embedded fillers such as gravel or sand particles or the like. The corresponding heating devices 7, 8 are connected to these mold part carriers 10, 11 by way of the corresponding thermally conductive compounds, or, in the case of the second mold part 3, by way of the elastic intermediate layer 9.

Provision is furthermore made of a slide device 12 which is used to form an aperture in the finished casting during the molding operation. This slide device comprises a slide portion 13 which can be driven into the casting cavity 4 and which, proceeding from FIG. 1, can be displaced vertically, which is effected by means of compressed air fed in via a suitable connection 14. The slide portion 13 is arranged on a corresponding piston rod 15 which can be displaced axially. The piston rod 15, for its part, is arranged in a suitable rod receptacle 16, which is in turn connected to the actual cylinder 17 into which the compressed air is introduced, and in which the corresponding piston or pistons connected to the piston rod are also provided. The cylinder 17, for its part, is screwed by way of suitable screw connections 18 to the rod receptacle 16 which, for its part, is again screwed by way of suitable screw connections 19 to the metal layer 5, which is reinforced in this region.

Figure 8:
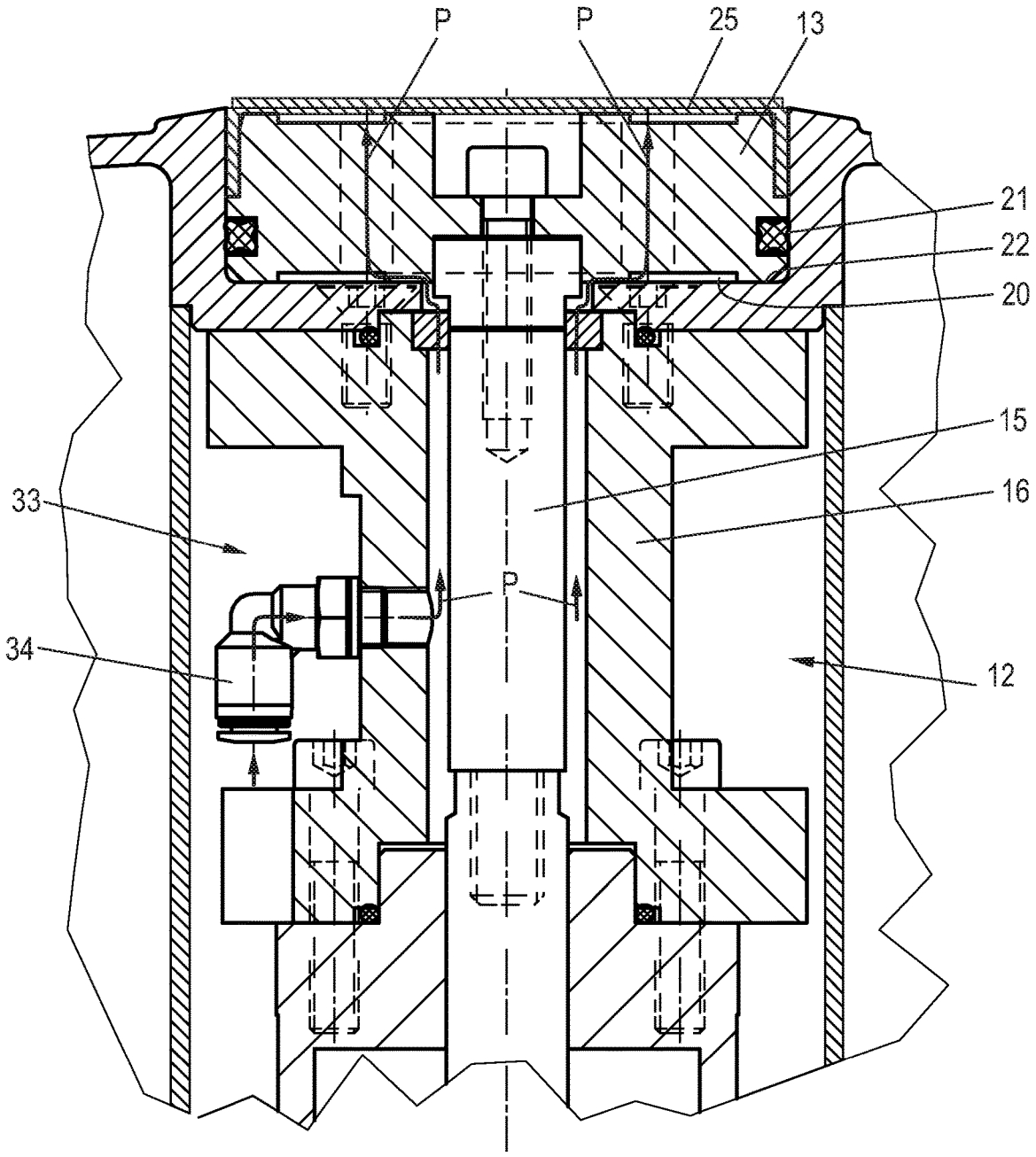
FIG. 8 shows an enlarged partial view of a part of the lower mold part illustrating a part of the slide device.

The metal layer 5 itself has a cylindrical recess 20 in which the cylindrical slide portion 13 is received. Arranged on the slide portion 13 is (see, in this regard, also the enlarged view according to FIG. 8) an encircling sealing element 21 which provides sealing with respect to the wall 22 of the recess 20.

In the working situation shown in FIG. 1, a cylindrical insert part 23, preferably composed of polypropylene, is placed on the slide portion 13 and completely covers the top side of the slide part 13. In the working position of the slide device 12 or of the slide portion 13 shown in FIG. 1, the latter is extended out of a non-working position, which will be described below, and driven into the casting cavity 4 filled with the casting compound, wherein the planar, free top side of the insert part 23 bears against the opposite metal layer 6, such that the insert part 23, the lower periphery of which is still received in the recess 20 even in the working position, produces an in this case cylindrical aperture in the casting compound which has not yet polymerized to completion. If the polymerization reaction subsequently begins, the insert part 23 is firmly embedded into the completely polymerized casting. The pushing down of the metal layer 6 by the elastic intermediate layer 9 for the shrinkage compensation ensures that the casting compound permanently laterally embeds the insert part. The slide device 12 or the slide portion 13 can also implement any shrinkage compensation during the polymerization operation, that is to say that the movement of the metal layer 6 against which the insert part 23 bears is also implemented by the slide portion 13 and it is pushed back slightly.

After complete polymerization, the slide portion 13 is moved vertically downward once the upper mold part 3 has been lifted off. Here, the insert part 23 which is firmly embedded in the casting is separated from the slide portion 13, and the insert part 23 remains in the casting which is then demolded.

Figure 2:
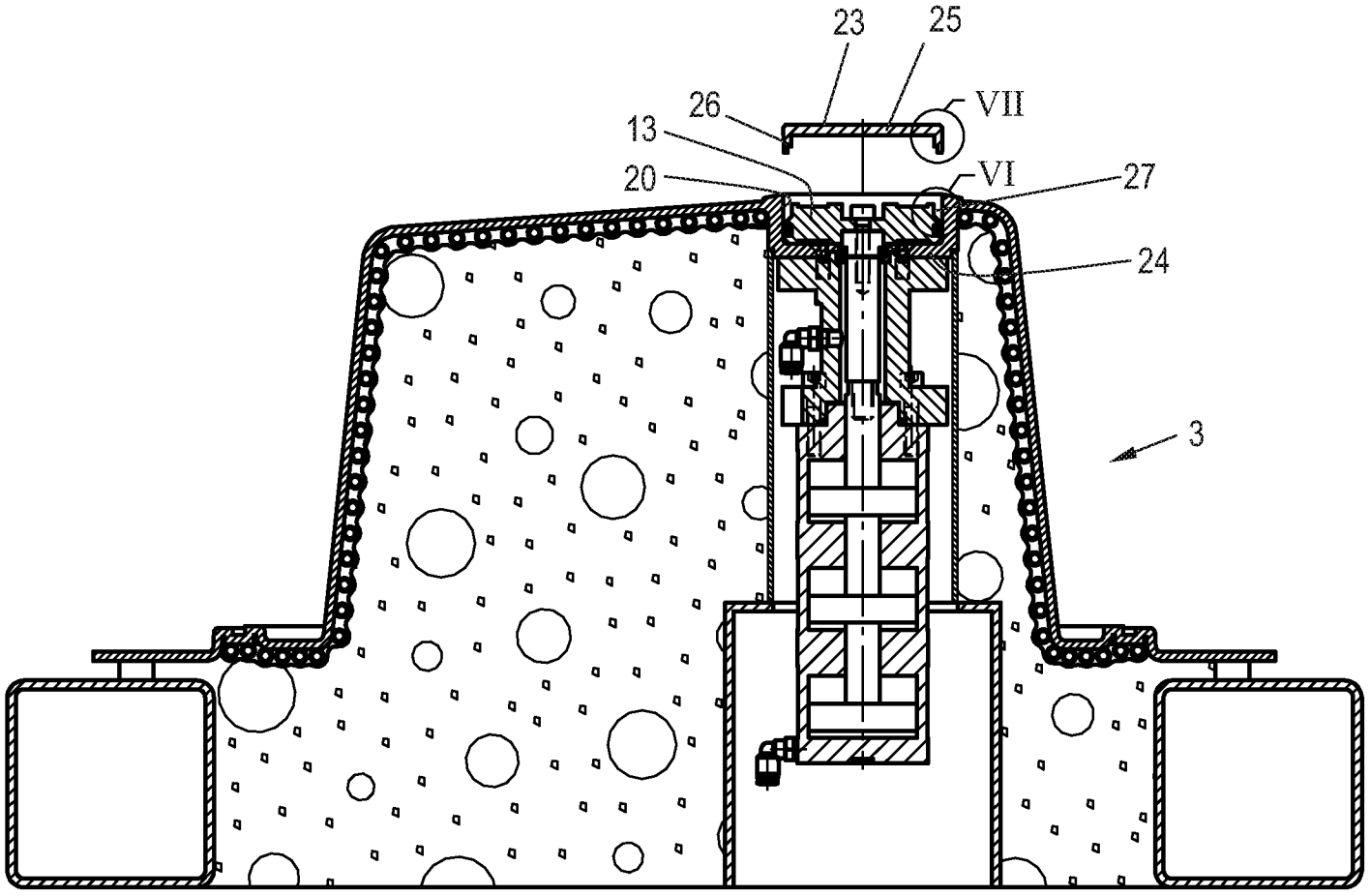
FIG. 2 shows the view of the lower mold part with the insert part not yet placed.

FIG. 2 shows, in the form of an exploded view, the lower mold part 3 with the slide portion 13 in the non-working position. As FIG. 1 clearly shows, said slide portion is located inside the recess 20, that is to say is completely retracted, and its bottom side rests on the base 24 of the recess 20. The insert part 23 has not yet been placed, and it is located at a distance from the slide portion 13 and is placed thereon manually. This situation is shown in FIG. 3.

Figure 3:
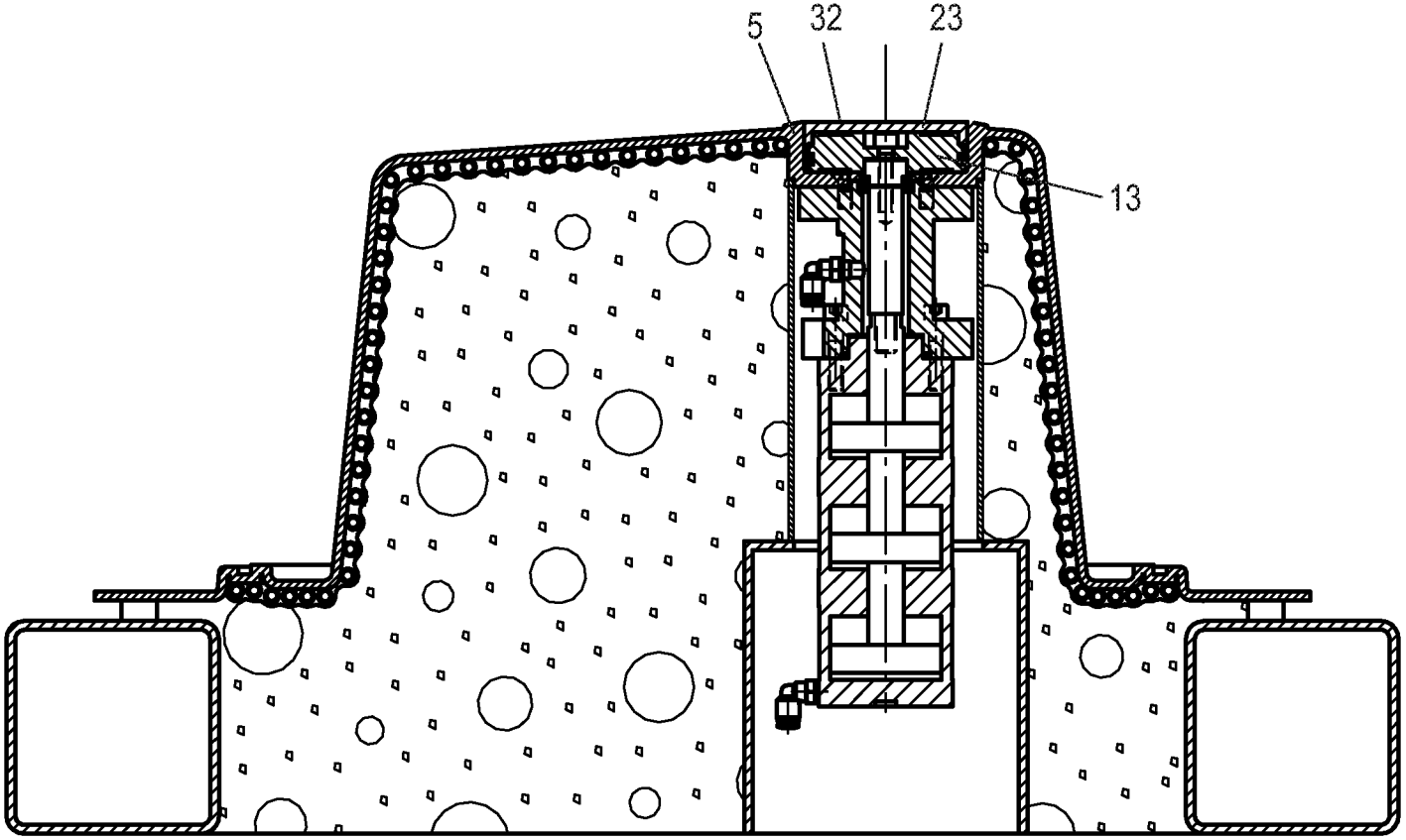
FIG. 3 shows the arrangement from FIG. 2 with the insert part placed.

In FIG. 3, the insert part 23 sits firmly on the slide portion 13. In this situation, the second, upper mold part 3 can then be lowered and placed, after which the actual casting process as described above can begin.

Figure 4:
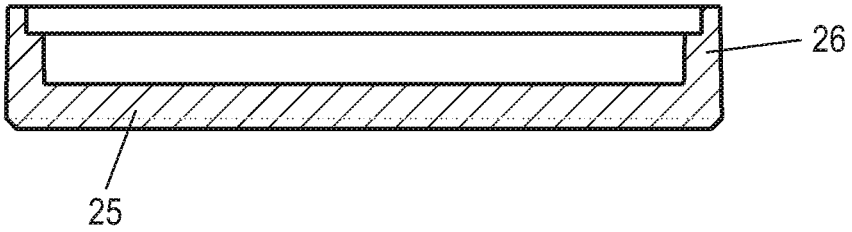
FIG. 4 shows a sectional view through the insert part from FIGS. 2 and 3.
Figure 5:
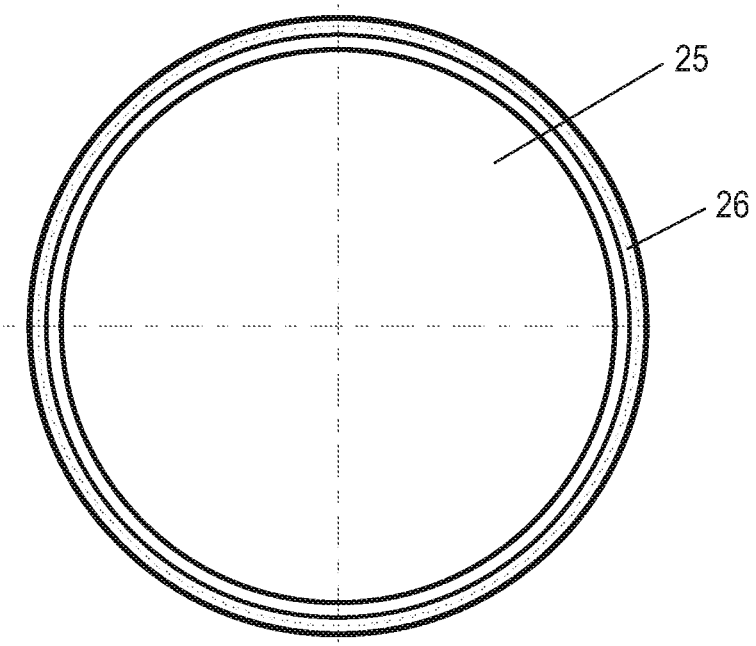
FIG. 5 shows a plan view of the insert part from FIG. 4.

The insert part 23 is of virtually lid-like embodiment and has an annular-disk-like base plate 25 (see, in this regard, also FIGS. 4 and 5) which is adjoined by an encircling annular flange 26. The insert part 23 engages by way of this annular flange 26 into a corresponding receiving rabbet, which is embodied here as an annular rabbet 27, in the slide portion 13, as is in particular shown by a comparison of FIGS. 2 and 3. For the insertion, the insert part 23 is placed from above onto the slide portion 13, such that the annular flange 26 engages into the annular rabbet 27, while the base plate 25 sits on the top side of the slide portion 13.

Figure 6:
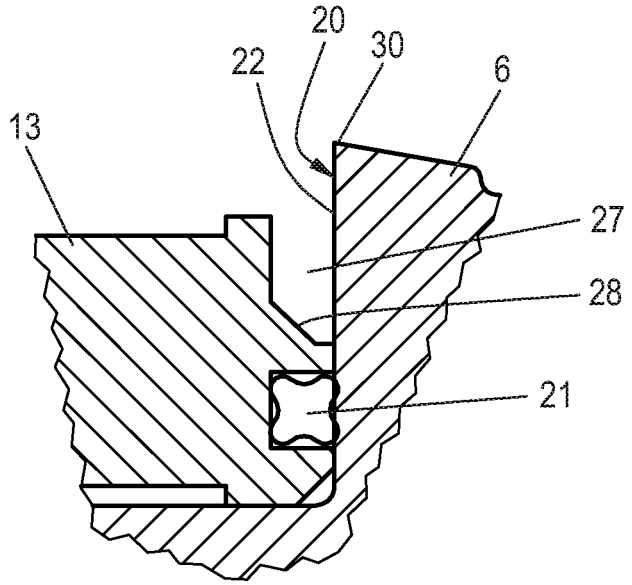
FIG. 6 shows an enlarged partial view of region VI in FIG. 2.
Figure 7:
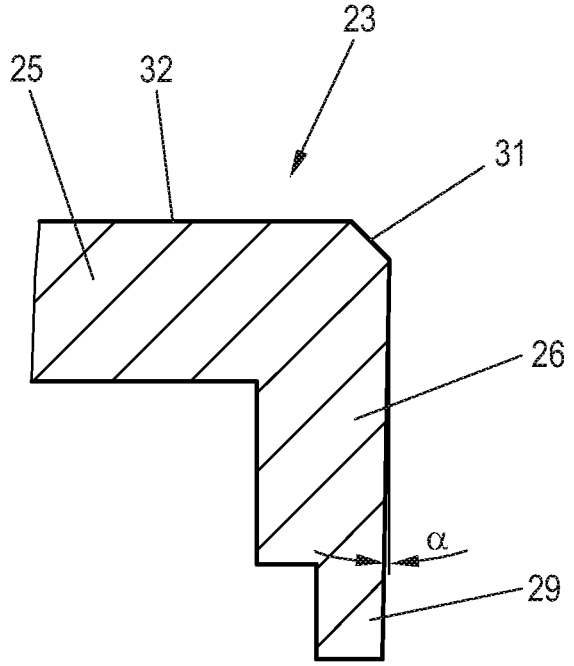
FIG. 7 shows an enlarged partial view of region VII in FIG. 2.

Details of the insert part 23 and of the slide portion 13 and of the metal layer 6 in the region of the recess 20 can be gathered from FIGS. 6 and 7.

FIG. 6 shows an enlarged partial view of region VI from FIG. 2. Part of the metal layer 6 in the region of the recess 20 and part of the slide portion 13 in the region of the annular rabbet 27 are shown. The annular rabbet 27 has a chamfer 28, that is to say a conical portion, which extends downward as seen vertically from above. The lower free end 29 of the annular flange 26 runs against this chamfer 28, wherein the material thickness of this lower free end 29 is reduced, see FIG. 7, and consequently is somewhat more pliable and deformable. This ensures that the insert part 23 or the annular flange 26 is pushed radially into a first firm sealing abutment against the wall 22 of the recess 20. This is because when the slide portion 13 provided with the insert part 23 is being extended, the insert part 23 already pushes against the introduced casting compound during the extending movement and attempts to displace it. By way of this pressure, the insert part 23, which until then may have had its base plate 25 positioned with a small spacing to the receiving region of the slide portion 13, is pushed entirely into abutment. This operation may also take place only upon direct contact with the opposite metal layer 6. In each case, the end 29 slides along the chamfer 28 and is in this case deformed or widened slightly toward the side, such that a firm sealing abutment against the wall 22 of the recess 20 is pushed. This deformation is also accompanied by a certain overall deformation of the annular flange 26, such that an areal sealing abutment with the metal layer 6 is provided and is maintained during the entire extending movement or abutting movement against the metal layer 6. This ensures that no casting compound can enter the region of the recess 20. A sealing edge 30 which is formed on the metal layer 6 and which borders the recess 20 at the end side in the form of a sharp edge is also conducive to the sealing. This sealing edge, which may also project slightly into the recess 20, constitutes an additional sealing plane with respect to the annular flange 26.

As also shown in FIG. 7, the insert part 23 has, at its outer edge facing the second mold part 3, a chamfer 31 which directly adjoins the planar base surface 32 with which the insert part 23 bears against the likewise planar metal layer 6 in the working position. This chamfer 31 defines an annular space which is inevitably filled with casting compound. In the completely polymerized state, a narrow annular periphery of the casting is formed, said annular periphery engaging over the insert part 23, serving as an abutment and ensuring that the insert part 23 is not pushed out in an uncontrolled manner during the later demolding with compressed air. The angle of the chamfer 31 is for example about 45°.

An angle $\alpha$ is also illustrated in FIG. 7. The angle $\alpha$ defines a certain conicity of the annular flange 26, and it enables easier insertion and an improved sealing function in the region of the sealing edge 30. The angle $\alpha$ is for example about 1°.

FIG. 3 shows, as described, the non-working position when the insert part 23 has been placed onto the slide portion 13 but the latter is not yet completely in the recess 20. It is evident that the base surface 32 of the insert part 23 terminates flush with the sealing edge 30 of the metal layer 6, such that in this region a planar geometry is produced which ensures that the slide portion 13 and the insert part 23 do not constitute a flow obstacle for the casting compound flowing in under pressure and homogeneous filling of the casting cavity 4 is achieved.

As described, for the displacing of the slide portion 13 together with the insert part 23, compressed air is used which is guided via the compressed-air connection 14 into the cylinder 17, such that the respective piston arrangement, which is carried by the piston rod 15, is pushed axially upward and the slide portion 13 is displaced linearly in the recess 20 and moved in the direction of the second mold part 3 until the insert part 23 has achieved a firm areal abutment against the second metal layer 6. After full polymerization and possibly after the casting mold 1 has been opened by raising of the second mold part 3, the slide portion 13 is pulled back again, likewise in a manner controlled by compressed air, that is to say that the air distribution in the cylinder 17 is reversed. Since, however, the insert part 23 at this point in time is firmly embedded into the cured casting compound, that is to say the casting, it remains therein, thus it detaches from the downwardly moving slide portion 13. The subsequently shaped molding thus has the desired shape but also the insert part 23 which defines a defined cylindrical aperture, here a sink outflow. The insert part 23 is then knocked out in a simple manner mechanically, for example by means of a rubber hammer, after the casting has been completely demolded, that is to say has also been removed from the first mold part 2.

This demolding can be assisted by the slide device 12 by virtue of the slide device being used as an additional ejector device. To this end, the slide device 12 has (see FIG. 8) a compressed-air distributing device 33, comprising a further compressed-air connection 34 which is arranged on the rod receptacle 16 in which the piston rod 15 is in turn arranged with a spacing. The arrangement is such that the compressed air fed in flows to the side of the piston rod 15 and ultimately builds up an air pressure which is applied (see the flow arrows P) to the bottom side of the base plate 25. This means that ultimately a pushing action from below against the insert part 23 which is firmly embedded in the polymerized casting is effected by way of the compressed air, wherein the insert part 23, as described, is secured against a movement in this pushing direction by way of the polymerized annular periphery of the casting, said annular periphery filling the chamfer 31. This annular periphery consequently forms an abutment which prevents the insert part 23 from being, as it were, shot out by the compressed-air pressure applied to the bottom side. This air pressure from below can assist the lifting off of the finished molding from the first mold part 2.

After this final demolding, the insert part 23 is, as described, mechanically separated from the casting and pushed or knocked out. The insert part 23 preferably consists of a plastic, preferably a polypropylene, but the invention is not restricted thereto. A plastic which has the lowest possible adhesion to the polymer material from which the casting is formed should be selected, such that the insert part 23 consequently forms only a very weak materially bonded connection, if any, to the casting and the pushing out or knocking out of the insert part 23 can take place in a simple manner.

Figure 9:
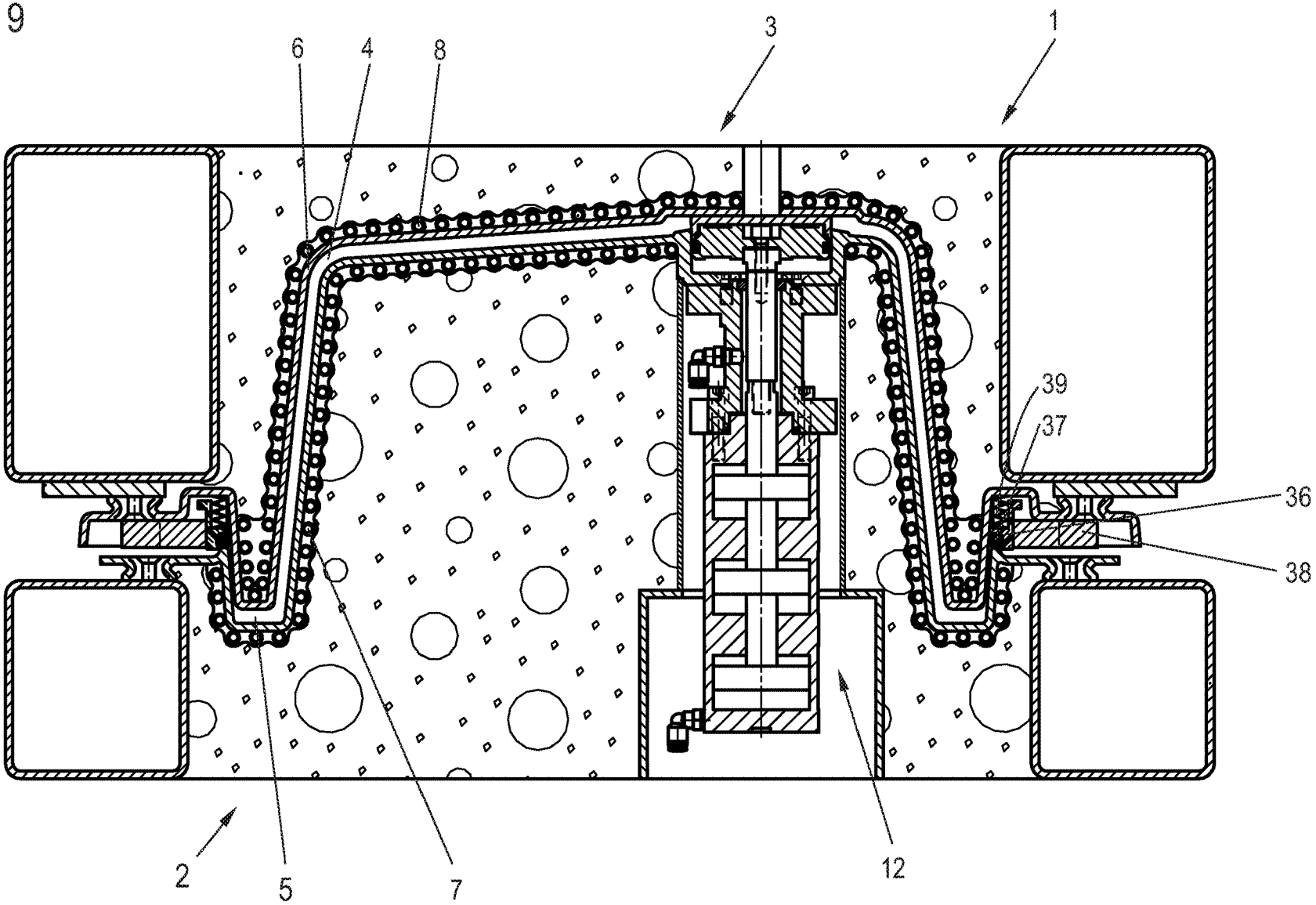
FIG. 9 shows a diagrammatic illustration of a further embodiment of a casting mold according to the invention.

FIG. 9 shows a further variant of a casting mold 1 according to the invention, the same reference designations being used for the same components.

The casting mold 1 also comprises two mold parts 2, 3 which delimit a casting cavity 4 by way of two metal layers 5, 6 which can be heated by way of a heating device 7, 8 embedded into a thermally conductive compound. A slide device 12 according to the invention is also provided.

In contrast to the embodiment of the mold described above with integrated shrinkage compensation, here the two mold parts 2, 3 are movable relative to one another in order to compensate for shrinkage. An encircling, movable holder 36 for a sealing element 37 such as a sealing rubber is provided, which sealing element 37 bears tightly against the two mold parts 2, 3 or the two metal layers 5, 6. The holder 36 itself is arranged on a holder receptacle 38. The movable holder 36 is braced by way of spring elements 39, such that a sealing abutment of the sealing element 37 against the two metal layers 5, 6 is always provided, even when said metal layers or the two mold parts 2, 3 move relative to one another for shrinkage compensation. In this mold configuration, a very thin casting periphery, which has to subsequently be removed, is formed on account of the peripheral engagement of the metal layer 5 around the metal layer 6.

In the exemplary embodiments, a slide device is in each case shown in a cylindrical construction. It is alternatively conceivable for the recess and the slide portion to have a cross-sectional shape which deviates from a circular shape, wherein the insert part has a base plate which is shaped correspondingly to this cross-sectional shape and a flange which engages into a receiving rabbet in the slide portion. It is thus also possible for apertures which deviate from a circular shape to be generated by means of the slide device provided according to the invention.

Equally, the invention is not restricted to the shown constructions of the casting mold or of the mold parts. Rather, the invention covers any casting mold construction having two mold parts of any desired embodiment which delimit the casting cavity and which are used to produce a casting by any desired curing methods, i.e. both in heat-curing and cold-curing form.

While specific embodiments of the invention have been shown and described in detail to illustrate the inventive principles, it will be understood that the invention may be embodied otherwise without departing from such principles.

We claim:

1. A casting mold for producing a casting having a front side and a rear side from a curable casting compound, comprising: at least a first mold part shaping the front side; a second mold part shaping the rear side, said mold parts together delimiting a casting cavity;

and a slide device provided on one of the mold parts, the slide device including a slide portion which can be driven into the casting cavity and on which a detachable insert part is or can be arranged, wherein said insert part defines an opening extending from the front side to the rear side of the casting, said insert part being able to be moved by the slide portion into the casting cavity filled with the casting compound so as to displace the casting compound and abutting against the opposite mold part and being able to be embedded into the curing casting compound, and being detached from the slide portion when the latter is moved back after the casting compound has cured.

2. The casting mold according to claim 1, wherein the one of the mold parts provided with the slide device has, on a side delimiting the casting cavity, a recess in which the slide portion is received and out of which the slide portion is at least partially movable.

3. The casting mold according to claim 2, wherein the slide portion has an encircling sealing element which provides sealing with respect to a wall of the recess.

4. The casting mold according to claim 2, wherein the insert part has a base plate and an encircling flange which peripherally adjoins said base plate, wherein, in an assembled position, the base plate sits on a supporting portion of the slide portion and the encircling flange engages into an encircling receiving rabbet in the slide portion and is at least partially received in the recess.

5. The casting mold according to claim 2, wherein the recess and the slide portion are cylindrical, and in that the insert part has a round base plate and an annular flange which engages into an annular rabbet in the slide portion, or in that the recess and the slide portion have a cross-sectional shape which deviates from a circular shape, wherein the insert part has a base plate which is shaped correspondingly to this cross-sectional shape and a flange which engages into a receiving rabbet in the slide portion.

6. The casting mold according to claim 4, wherein the base plate is arranged flush with a peripheral surface, delimiting the recess, of that side of the mold part which delimits the casting cavity.

7. The casting mold according to claim 4, wherein the encircling flange bears in sealing abutment against a wall of the recess at least when the insert part is in the position bearing against the mold part without the slide device.

8. The casting mold according to claim 7, wherein the encircling receiving rabbet has a chamfer against which the free end of the encircling flange bears, wherein, during the movement of the slide portion in the direction of the other mold part or upon contact against the other mold part, the encircling flange slides along the chamfer of the encircling receiving rabbet and widens in encircling fashion against the wall.

9. The casting mold according to claim 8, wherein the wall thickness of the flange is reduced at its free end.

10. The casting mold according to claim 2, wherein the recess has, at the end facing the casting cavity, an encircling sealing edge which bears sealingly against the inserted insert part.

11. The casting mold according to claim 1, wherein the insert part has a facing outer edge with a chamfer in a position bearing against the mold part without the slide device.

12. The casting mold according to claim 1, wherein the slide device is also used as an ejector device for lifting off the cured casting from the mold part.

13. The casting mold according to claim 12, wherein a compressed-air distributing device is provided on the slide device and can be used to conduct compressed air onto a lower side of the insert part, said lower side being seated on the slide portion.

14. The casting mold according to claim 1, wherein the insert part is composed of a plastic.

15. The casting mold according to claim 1, wherein the first mold part has a first metal layer delimiting the casting cavity and the second mold part has a second metal layer delimiting the casting cavity.

16. The casting mold according to claim 15, wherein the recess is formed in one of the two metal layers.

17. The casting mold according to claim 15, wherein the second metal layer of the mold part against which the insert part is moved is at least partially deformable for the purpose of changing the volume of the casting cavity, or in that at least one mold part is movable relative to the other mold part for the purpose of changing the volume of the casting cavity.

18. The casting mold according to claim 17, wherein the mold part has an areal intermediate layer which is composed of an elastically deformable and compressible material and against which the second metal layer of the mold part is movable with build-up of a restoring force on a part of the intermediate layer.

* * * * *